US006209272B1

(12) United States Patent
Holzaepfel

(10) Patent No.: US 6,209,272 B1
(45) **Date of Patent: *Apr. 3, 2001**

(54) TRANSPARENT PANEL AND SURROUNDING CLOSURE AND A METHOD FOR ITS CREATION

(75) Inventor: John R. Holzaepfel, Peachtree City, GA (US)

(73) Assignee: Morgan Products, Ltd., Williamsburg, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/639,830

(22) Filed: Apr. 29, 1996

(51) Int. Cl.[7] ..... E04B 1/04

(52) U.S. Cl. ..... 52/204.591; 52/204.62; 52/456; 52/766; 52/780

(58) Field of Search ..... 52/204.591, 204.593, 52/204.62, 204.64, 204.7, 204.705, 456, 766, 780; 156/107, 108, 109

(56) References Cited

U.S. PATENT DOCUMENTS 2,252,197 * 8/1941 Passer ..... 52/204.705
2,716,784 * 9/1955 Kuyper ..... 52/205.705
3,652,380 * 3/1972 Strack ..... 52/504.591 X
3,708,939 * 1/1973 Herr ..... 52/456
3,881,290 * 5/1975 Bouchey ..... 52/204.591 X
4,144,684 * 3/1979 Kirkbride et al. .
4,151,696 * 5/1979 Knights et al. ..... 52/204.591 X
4,463,540 * 8/1984 Gordon ..... 52/730.2
4,586,306 * 5/1986 Webb ..... 52/204.61
4,703,598 * 11/1987 Wilson et al. ..... 52/204.591 X
4,803,520 * 2/1989 Metrick ..... 52/204.591
5,107,643 * 4/1992 Swensen ..... 52/202
5,138,811 * 8/1992 Parrott .
5,339,583 * 8/1994 Hrdlicka et al. ..... 52/204.53
5,360,645 * 11/1994 DeVries .
5,370,905 * 12/1994 Varga et al. .
5,603,585 * 2/1997 Bruchu et al. ..... 52/780 X
5,622,017 * 4/1997 Lynn et al. ..... 52/204.5 X

* cited by examiner

*Primary Examiner*—Richard Chilcot
(74) *Attorney, Agent, or Firm*—Foley & Lardner

(57) ABSTRACT

A method of making a seal on a panel for a door or window by applying and curing a sealant on the surface of the panel is provided, preferably by screening the sealant onto the surface of the panel. The panel with the seal is mounted in a window or door frame such that the seal is disposed between the panel and the frame itself. To assemble the door or window, the panel may be inserted into "U" shaped grooves in the structural members comprising the door and the frame members assembled about the panel. The panel may have multiple layers with such seals interposed between the layers.

16 Claims, 6 Drawing Sheets

TRANSPARENT PANEL AND SURROUNDING CLOSURE AND A METHOD FOR ITS CREATION

FIELD OF THE INVENTION

The present invention relates generally to the sealing of light-transmissive planar panels to window or door frames. More particularly, the invention relates to an improved technique for applying a seal to a window pane and subsequently sealing the pane to a window or door frame.

BACKGROUND OF THE INVENTION

Effectively sealing light-transmissive panels in window and door frames is a recurring problem for manufacturers. This problem is compounded when the door or window frame to which the panel is sealed is an uneven or rough material, such as wood, or is exposed to wide variations in temperature. Previous sealing solutions include the application of a putty-like glazing compound between the panel and the frame to which the panel is to be sealed. This method requires the manual application of the glazing compound to the surface of the door or window at the appropriate places, placement of the panel in contact with these sealing surfaces, disposing panel retainers (commonly called "sticks") against the panel to compress the glazing compound between the panel and the sealing surfaces, and attaching the sticks to the door or window frame (typically by nailing) to retain the panel within the door or window. During this process, the putty-like glazing may be extruded from between the sealing surfaces and the panel, providing a bead of glazing that must be tediously trimmed once it has hardened.

There are several disadvantages to this process. First, the glazing compound is often applied unevenly to the door or window frame before insertion of the panel, thus providing a sealing layer of uneven thickness between the panel and the door or window. Even if it is applied evenly, it may become uneven when the panel is pressed into the glazing on the frame and the glaze is thereby unevenly extruded, leaving voids and gaps between the panel and the frame that often leak. Second, the extruded glazing compound is esthetically unpleasant, and must be cleaned off, typically after it has hardened. Third, it is difficult to completely clean the extruded glazing compound off the panel and the door or window. Fourth, attaching each of the panel retainers takes a considerable amount of time and care.

There is a need, therefore, for an improved seal or gasket for a transparent panel and a method for installing that panel.

SUMMARY OF THE PRESENT INVENTION

The present invention provides a novel seal for, and method of creating it on, a panel for a window or door. The seal is particularly well-suited to sealing transparent panels, especially glass panels, in wooden doors or windows. A 0.005 inch to 0.5 inch thick seal or gasket material is applied to the panel through a stencil or screen oriented in proximity to the panel. The sealant can be applied in a complex pattern on the surface of the panel without time consuming efforts to manually trace out and apply the sealant on the surface. The sealant, typically having a liquid, gel or pastelike consistency, is then cured to a solid resilient state to form a gasket or seal. Once cured, the panel with bonded seal can be mounted in an opening in a door or window. The panel with seal may be inserted into a preassembled frame and secured with panel retainers, or may be compression assembled together with the individual frame members.

Thus, in accordance with the present invention, a method for creating a seal for a panel is provided, including the steps of placing a screen having sealant transmissive regions in close proximity to the panel, conveying a sealant through the regions of the screen onto the light-transmissive panel, and curing the sealant to form a resilient seal. The sealant may be plastisol and may be cured by heating. It may have a width of between 0.125 inches and 0.75 inches, and a thickness of between 0.010 and 0.25 inches. It may be recessed from the edge of the panel, preferably between 0.02 and 0.375 inches, and may have a hardness of between 10 and 60 durometer, or more preferably between 25 and 40 durometer.

In accordance with a second embodiment, a gas and liquid resistant closure for a building is provided, having a structural frame, a light-transmitting panel having an outer edge mounted within the structural frame, and a resilient seal disposed between the frame and the panel, formed by applying a liquid sealant to a first surface of the panel and curing the sealant. The panel may be glass or plastic, and may be inserted in a door or window frame. The frame may have a groove for receiving the panel and a portion of the resilient seal, such that the resilient seal is disposed between the panel and the frame. This groove may have an included angle of less than twenty degrees, or more preferably be between four and ten degrees. The frame may be formed of wood.

In accordance with a third embodiment of the invention, a method for assembling a closure for a building having a transparent panel and at least one structural member for supporting the panel is claimed, comprising the steps of applying a sealant to the edge of a transparent panel, curing the sealant to form a resilient seal, and inserting a first edge of the transparent panel into a groove in a structural member in a direction substantially parallel to the plane of the panel and perpendicular to the first edge. The panel may be inserted so that the seal is disposed between the panel and a portion of the groove. A second edge of the panel may be inserted into a second grooved structural member in a direction parallel to the plane of the panel and perpendicular to the second edge. The sealant may be applied in a thickness of between 0.01 and 0.25 inches, and may be applied on one or both planar surfaces of the panel.

In accordance with a fourth embodiment of the invention, a method of creating a window from a plurality of light-transmissive panels of substantially the same planar dimensions is provided, including the steps of applying sealant onto a first planar surface of a first panel along its periphery, curing the sealant to form a first resilient seal, and joining a first planar surface of a second panel to the resilient seal. The sealant may be screened onto the first panel. Sealant may also be applied to the periphery of the second surface of the first panel and cured to form a second resilient seal. Sealant may also be applied to the periphery of the second planar surface of the second panel and cured to form a third resilient seal.

Other principal features and advantages of the invention will become apparent to those skilled in the art upon review of the following drawings, the detailed description and the appended claims.

Figure 1:
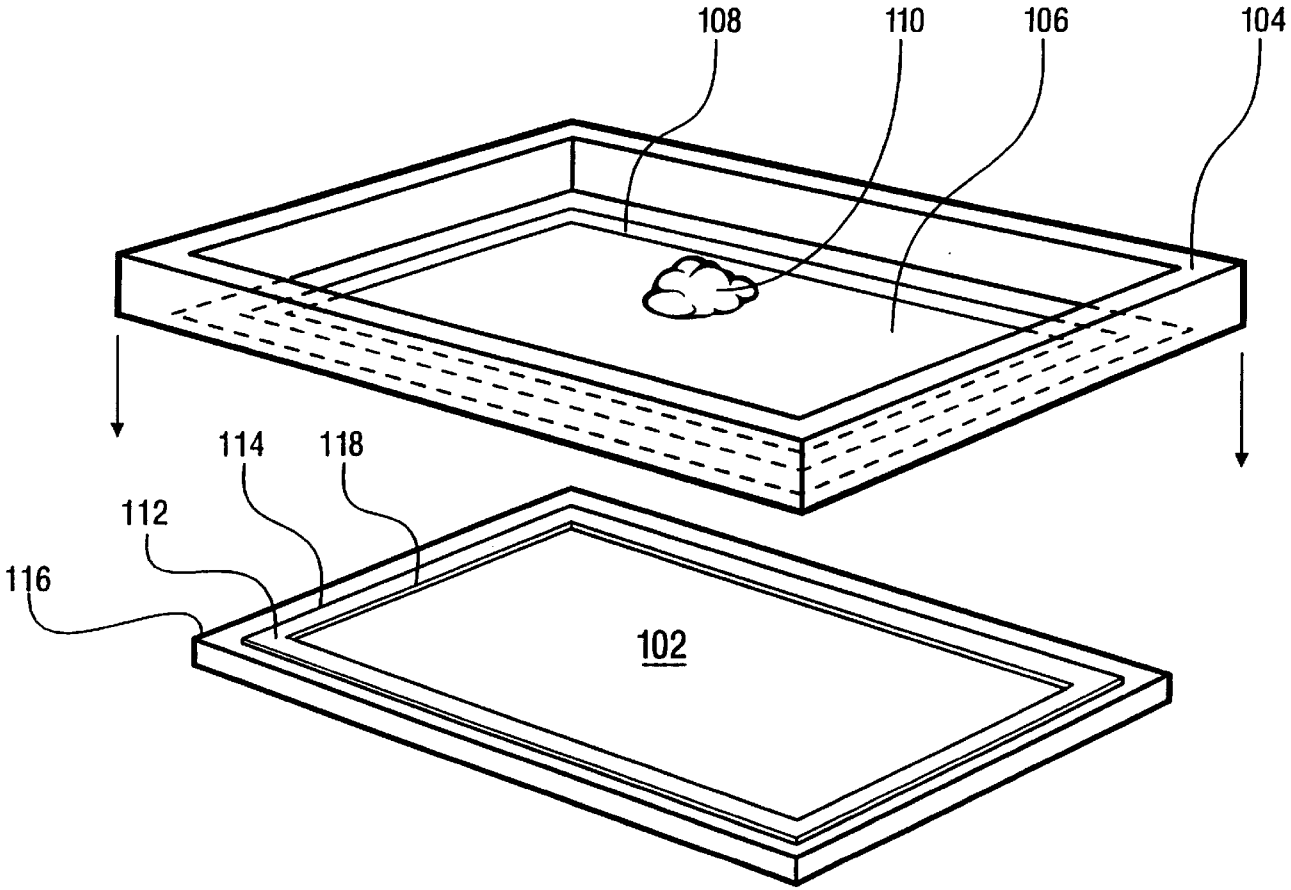
FIG. 1 is an illustration of a transparent panel and screen for applying sealant thereto in close proximity.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Turning now to the drawings, FIG. 1 illustrates the application of sealant to a transparent panel 102 through a screen. The screen includes a frame 104 that holds the screen 106 in close proximity to panel 102, when frame 104 is lowered toward panel 102. Sealant 110, shown on the surface of screen 106 is spread across the surface of screen 106 and penetrates screen 106 through pattern 108 (a transmissive region of screen 106) which is adapted to transmit sealant 110 through screen 106 to panel 102 when screen 106 is lowered into contact with panel 102.

The screen is preferably made of threads or ribbons of silk, metal, polymeric material or equivalents thereof. The screen preferably has a mesh of between 10 and 90. More preferably, it has a mesh of between 30 and 70. Most preferably, it has a mesh of between 40 and 60. Screens with a larger mesh can be used with more viscous sealants, and will provide a thicker layer of sealant than a finer mesh screen. A stencil may be employed in place of screen 106.

Not all portions of the screen transmit the sealant. To prevent the transmission of sealant onto the surface of the panel where it is not desired, a sealant-proof film is typically applied to the surface of the screen. The thickness of the applied film, and thus the thickness of the resultant sealant on the surface of the panel may be controlled by applying multiple and successive layers of film to the surface of the screen until the proper film thickness is produced. In this manner, the thickness of the sealant applied to the surface of the panel can be controlled. The portions of the screen that have not been covered with film will transmit the sealant to the surface of the panel, such as pattern 108 of FIG. 1.

The screen shown in FIG. 1 is large enough to coat a single panel with sealant at a time. To provide for quicker production, the frame and screen may be enlarged to permit a plurality of panels to be oriented beneath a screen and simultaneously coated with sealant.

In FIG. 1, panel 102 is shown as having already been screened with sealant to create an uncured seal 112. The outer edge 114 of seal 112 is spaced away from outer edge 116 of the panel. This spacing is preferably in the range of 0.02 to 0.375 inches. The width of the seal, measured from its outer edge 114 to its inner edge 118 is preferably between 0.125 and 0.75 inches. The thickness of seal 112 is preferably between 0.01 and 0.25 inches, depending upon the type of panel (glass, plastic or wood) and the structural member to which the panel will be sealed. For most applications, such as those involving standard window glass as a panel material, a thickness of between 0.02 and 0.06 is preferred. The seal, depending upon the ultimate application, can be created from a single application of sealant, or can be built up by applying a sealant layer, curing it, and then repeating the process until a seal of sufficient thickness has been created. For seals on float glass panels, the sealant is preferably applied to the "air" side of the glass.

A seal can be applied to both sides of the panel to provide better sealing and to allow the panel to "float" with respect to a structural member to which it is sealed, shown below in FIGS. 3, 4 and 5. Alternatively and preferably, it can be applied to a single side of the panel.

A variety of sealants will provide a flexible resilient seal when cured. Plastisol, however, is preferred. Typically, the plastisol is applied to the surface of the panel (glass, in the preferred embodiment) in the manner shown in FIG. 1 and the panel is then heat-cured in an oven. Glass-bonding additives are preferably added to the plastisol to improve its adhesion to glass. The viscosity of the plastisol sealant applied to the panel is preferably in the range of 1–1.5 million centipoids, depending upon the environment. With a viscosity in this range, the sealant resists dripping or running once it is applied to the panel, yet is easily applied and curable to an acceptable hardness.

Heat-curing also varies depending upon the environment. For tempered window glass with a seal on the order of 0.03 inches thick, curing is performed at 350 degrees Fahrenheit for five minutes, or 400 degrees Fahrenheit for four minutes. As the curing temperature is increased, the curing time may be reduced and vice versa. The curing is preferably performed in a conveyor oven, in which the glass with sealant applied to the surface, is placed on a conveyor at the entrance of the oven, and is automatically conveyed through the oven to the exit after the proper amount of curing. The seal is preferably cured to a hardness of between 10 and 60 durometer, and more preferably of between 25 and 40 durometer. With a hardness in this range, the panel can be easily mounted into a window or door, yet will also provide an effective vapor or liquid seal.

Figure 2:
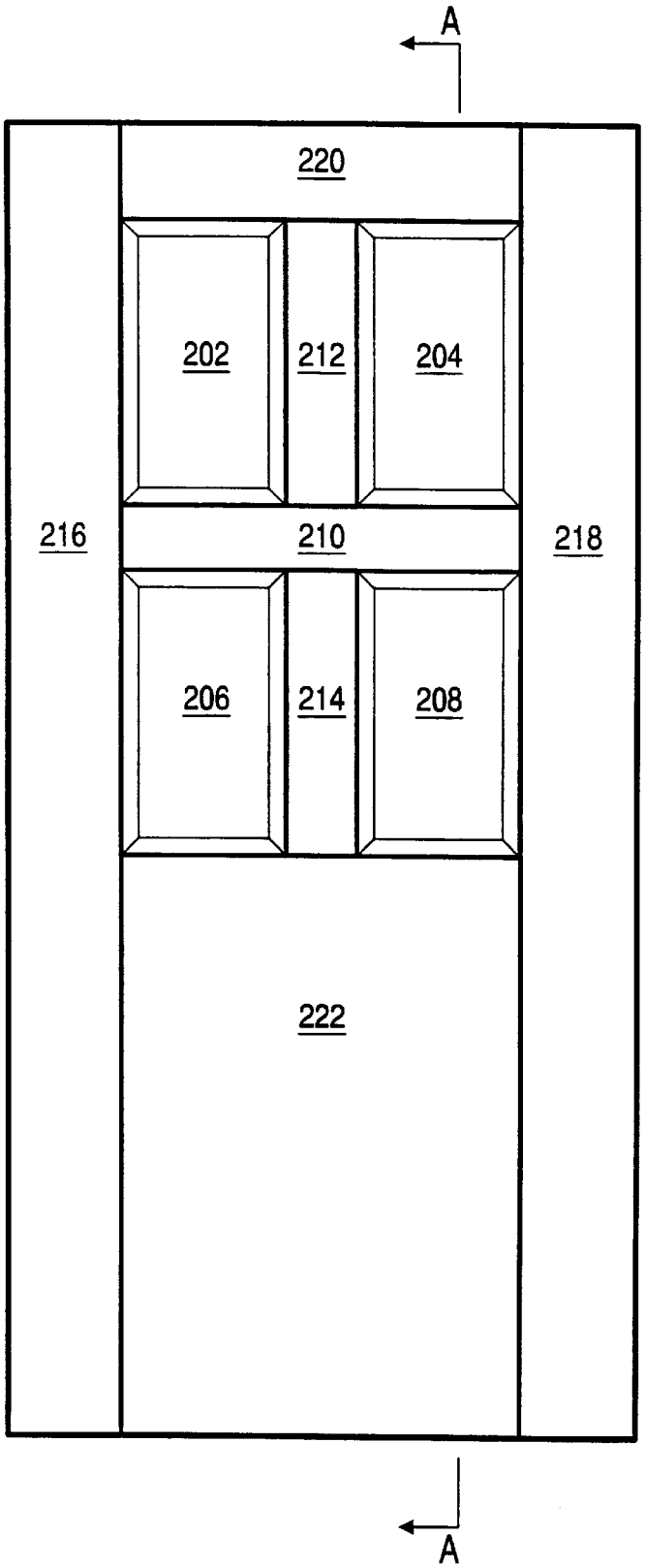
FIG. 2 is a front view of a door constructed using the panel of FIG. 1.

FIG. 2 illustrates a typical door or window frame in which the panel with seal is placed. In this embodiment, the door includes four transparent panels 202, 204, 206 and 208 with seals. The panels are separated by a horizontal member 210, called a "bar" and two vertical members 212 and 214, called "muntins" or "mutts." This panel assembly is oriented between two vertical members 216 and 218 called "stiles" and upper and lower members 220 and 222 called "rails." In a typical assembly, the bars, mutts, rails and stiles are assembled without the panels to create the structural frame of the door or window. Once assembled, the panels are inserted into the openings created in the door or window frame (in a direction substantially perpendicular to the plane of the panel) and are retained within the frame by panel retainers or "sticks" (shown in FIG. 3) which are pressed against the free surface of the panel and attached to the frame, thereby preventing the panels from being removed. In the prior art, the openings in the frame were coated with glazing and transparent panels were inserted into the openings and secured with sticks, causing the glazing extrusion, leakage, and cleanup described above. By utilizing transparent panels with bonded seals, these problems are avoided, as shown in FIG. 3, below.

Figure 3:
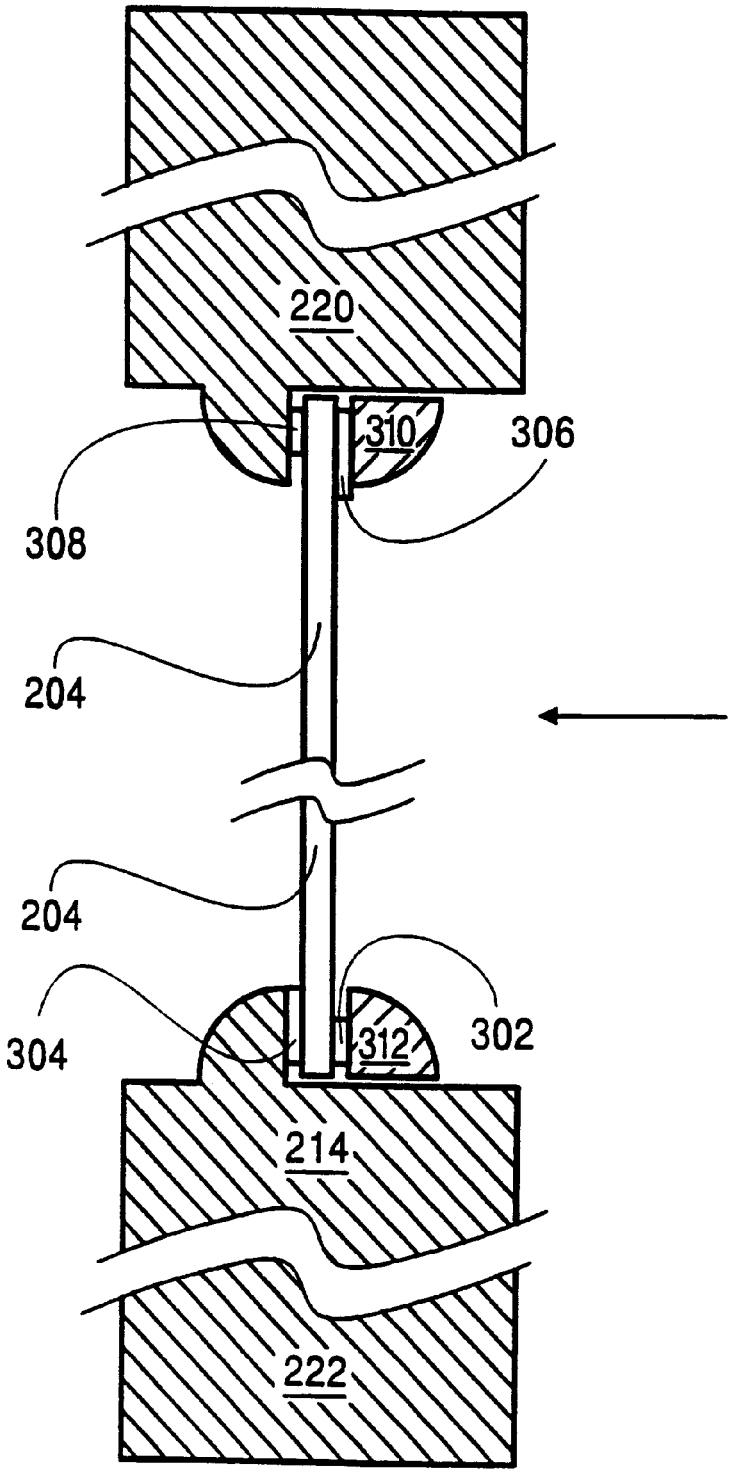
FIG. 3 is a cross-section of the door of FIG. 2, showing one panel.

FIG. 3 shows a cross section (Section A—A in FIG. 2) of one of the panels of the FIG. 2 door created as described above. The door contains a panel 204 with seals (indicated by items 302, 304, 306 and 308) formed around the periphery of the panel similar to the seal shown in FIG. 1. Panel 204 is supported in the frame by frame elements 210, 214, 218 and 220 (FIG. 2). Of these, frame elements 220 and 214 are shown in FIG. 3 in cross-section. In this embodiment, the seals are disposed on both sides of the panel to provide additional sealing capability. The panel is maintained in the frame by a panel retainer, which in this embodiment includes four "sticks," of which two (items 310 and 312) are shown in cross-section. In this embodiment, the panel with seals is moved in a direction substantially perpendicular to the plane of the panel such that the seal is disposed between and is in contact with both the frame and the panel, as indicated by the arrow. Once the panel is inserted into the frame, the sticks are placed against the second seal and are fastened to the door such that the second seal is disposed between panel 204 and the sticks. By providing seals on both sides of the panel, the panel can "float" with respect to the frame in which it is mounted. Alternatively and preferably, the seal can be removed from one side of the panel in the FIG. 3 embodiment, providing a single seal between the panel and bonded to a single side of the panel.

While the seals of FIG. 3 are shown as a ribbon around the periphery of the panel, they need not be initially created in ribbon form. To create the seals, a sealant can be applied to substantially all of the panel's surface, and then cured to provide a protective layer across the surface of the panel. This panel can then be mounted in an opening in a window or door frame, as described above, and the excess sealant subsequently trimmed, leaving a portion of the seal disposed between the panel and the structural member of the frame to provide sealing between the panel and the frame. In such an embodiment, the cured sealant provides not only a seal between the structural members and the transparent panel during use, but a protective layer on the exposed portion of the transparent panel's surface during assembly and shipping.

Figure 4:
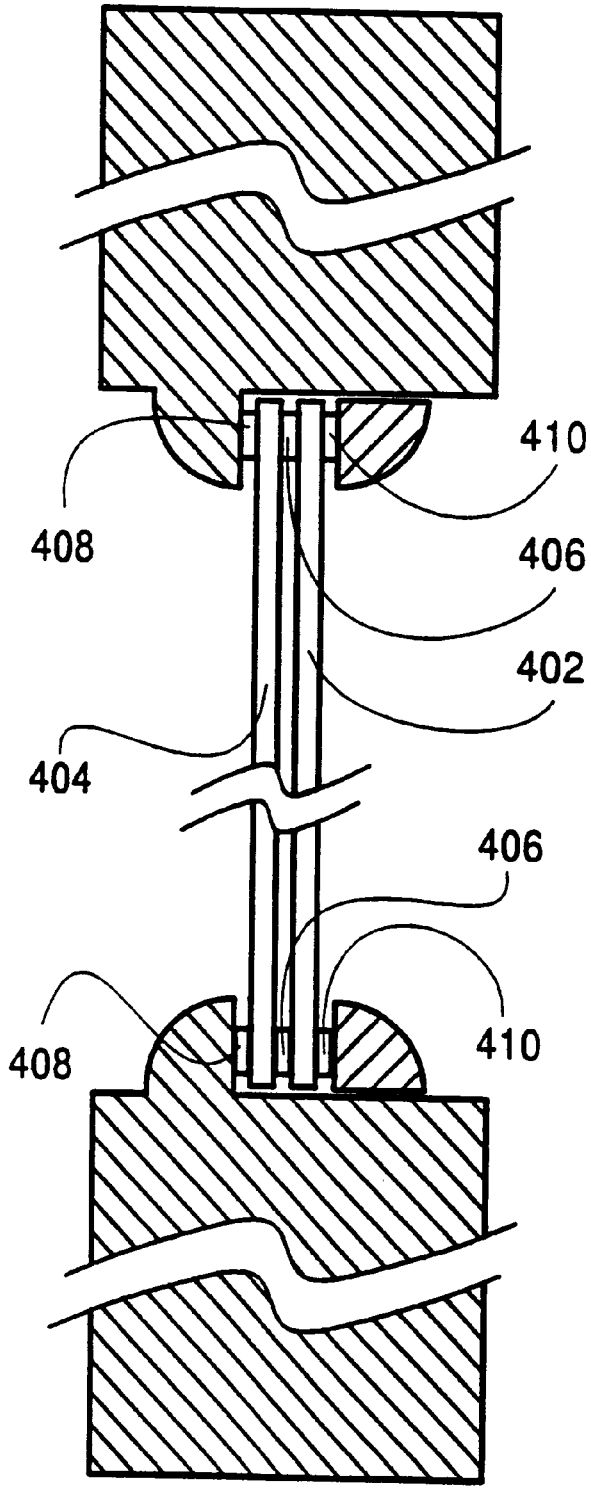
FIG. 4 is a cross-section of a door similar to that of FIG. 3, showing a double glazed panel with interposed seal.

Panels with seals are particularly suited to creating a multi-layer panel for a door or window as shown in FIG. 4. In this embodiment, a plurality of panels 402 and 404, separated by a seal 406, have seals 408 and 410 disposed on their outer surfaces. As in the prior embodiments, seal 406 is advantageously created by applying and curing a sealant on the surface of panel 402. Once the seal is formed, this panel is then joined to a second panel 404 with the seal interposed between and in contact with both panels, to create a double glazed panel having a gas-filled void disposed between them. As shown in this embodiment, additional seals 408 and 410, similarly created, may be provided on outer surfaces of this double glazed panel. This pair of panels can then be installed in a frame in the same manner that panel 204 of FIG. 3 was installed.

This traditional method of construction is not necessary, however, when a panel with bonded seal, such as the one disclosed here, is employed. It is especially well-adapted to a new method of constructing a door or window that heretofore was impossible using the glazing and stick method. This new and preferred method of construction is disclosed in FIG. 5.

In the embodiment of FIGS. 2 and 3, the frame of the door or window was preassembled and the panels were subsequently inserted in a direction substantially perpendicular to the longitudinal extent of the panel, followed by attachment of separate panel retainers. In the FIG. 5 embodiment, however, the panel retainers have been eliminated since the door or window frame is assembled around the panel and seal, rather than the panel inserted into the frame after its assembly.

Panel 502 with seals 504 and 506 is maintained in a frame member 508 in a "U" shaped groove 510 having substantially parallel and opposing interior surfaces 512 and 514. As with the panels of FIGS. 3 and 4, a seal can be applied to one or both surfaces of the panel. To provide for easy assembly yet allow an effective seal, the walls of the "U" shaped grooves preferably flare outward with respect to each other. This flare, shown here as angle $\phi$, is preferably less that twenty degrees. More preferably it is between four and ten degrees. Mouth 516 of the groove preferably has a minimum width equal to the combined thickness of panel 502 and the uncompressed seal or seals 504 and 506 to be inserted in the groove.

Figure 5:
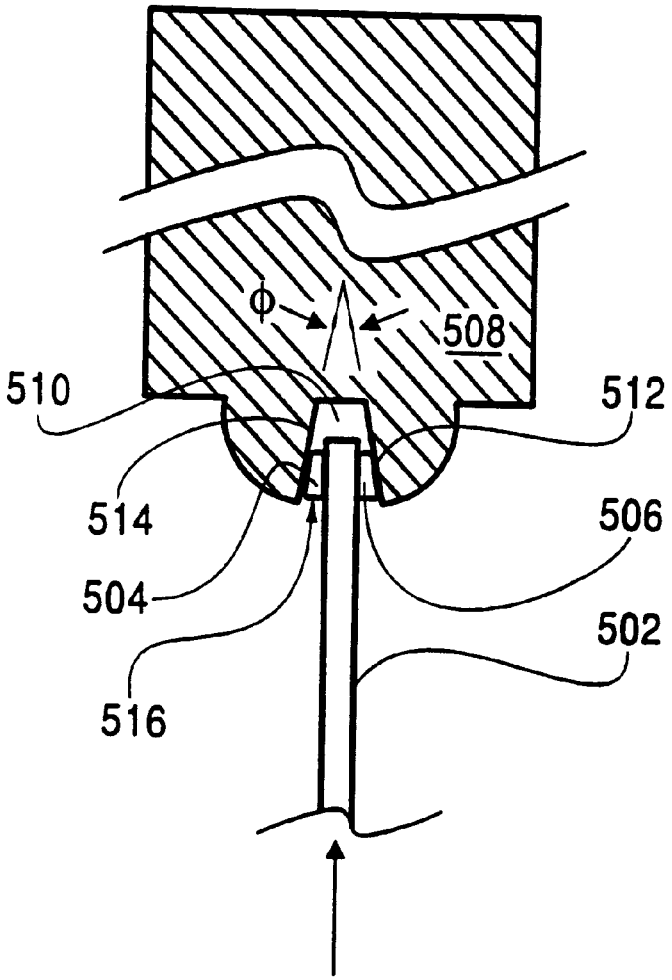
FIG. 5 is a cross-section of a door similar to that of FIG. 3 using structural members with grooves to retain the panel.
Figure 6:
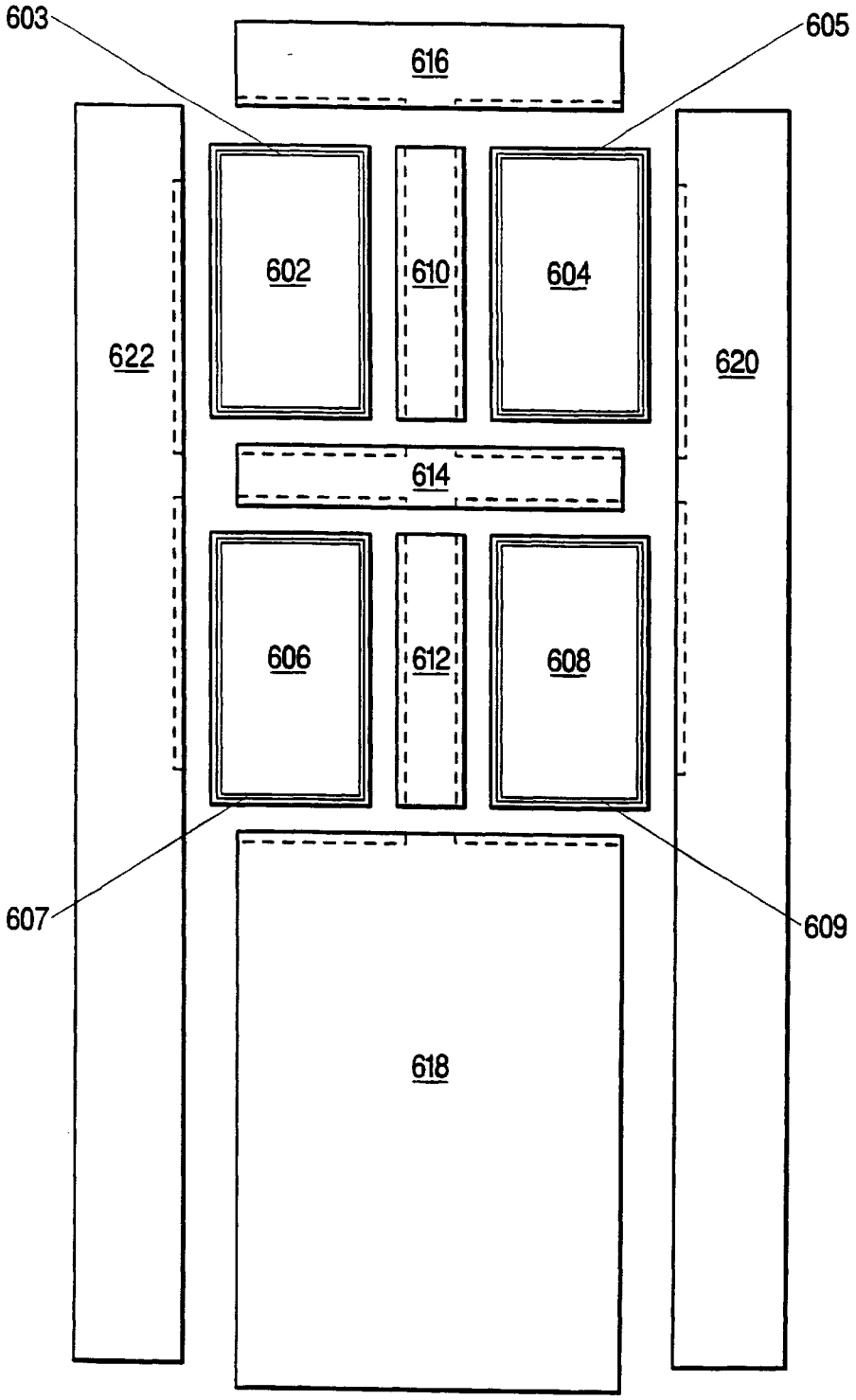
FIG. 6 is an exploded view of a door comprised of the structural members and panels of FIG. 5.

Unlike the embodiments of FIGS. 3 or 4, a frame having FIG. 5 grooves around the entire periphery of a panel cannot be preassembled before insertion of the panels. In such an embodiment the panel must be inserted into the "U" shaped grooves in a direction parallel to the plane of the panel (as shown by the arrow in FIG. 5), and therefore the frame must be assembled around the panel, rather than the panel inserted into a preassembled frame. FIG. 6 shows an exploded view of a typical door or window frame adapted to be assembled around panels. This frame is similar in overall construction to the embodiment of FIG. 2. It differs in that the FIG. 6 embodiment has frame members with FIG. 5 grooves (shown in FIG. 6 as dashed lines) that are adapted to be assembled around a panel, and not the panel retainers of FIG. 2.

To construct the FIG. 6 door, panels 602, 604, 606 and 608 with seals 603, 605, 607 and 609 are compression assembled with mutts 610 and 612, bar 614, rails 616 and 618, and stiles 620, 622 and 606 to create a door or window.

Panels with bonded flexible seals created by applying and curing a sealant to the surface of a panel are especially well suited to such a construction technique, since the seal allows the panel to move relative to the groove in which it is inserted, thus easing construction and reducing the risk of breaking a panel, and since the seal, by flexing, can allow some variation in the depth of panel insertion, while still providing a tight seal.

Wooden doors or windows show particular benefit in being constructed as described above, especially outside doors that are exposed to the elements. The panel seal provides superior resistance to moisture and gas leakage. Since wooden door frame elements can rarely be manufactured with complete accuracy and are also prone to warping, the flexible seal adapts to such irregularities in the sealing surfaces during the compression assembly process and to changes in such surfaces over time as the individual frame members comprising the door or window begin to age. Furthermore, expansion and contraction due to wide temperature changes, such as those experienced by external doors and windows are more readily accommodated by flexible seals.

Thus, it should be apparent that there has been provided in accordance with the present invention a transparent panel and surrounding closure and a method for its creation that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A gas and liquid resistant closure for a building, comprising:

a structural frame;

a panel having an outer edge mounted within the structural frame;

a first resilient seal which is cured on a first surface of the panel; and the frame defining a groove, the groove having a first wall and a second wall that flare outward at an included angle of less than twenty degrees, wherein the panel and a portion of the first resilient seal are positioned in the groove such that the first resilient seal is disposed between the panel and the first wall, and inner surfaces of the first and second walls are spaced apart a distance sufficient to cause the panel to be wedged into the groove without peeling the first resilient seal off the first surface when the panel is inserted into the groove, and further wherein the first resilient seal substantially cover all of the first surface of the panel.

2. A gas and liquid resistant closure for a building, comprising:

a structural frame;

a panel having an outer edge mounted within the structural frame;

a first resilient seal which is cured on a first surface of the panel;

the frame defining a groove, the groove having a first wall and a second wall that flare outward at an included angle of less than twenty degrees wherein the panel and a portion of the first resilient seal are positioned in the groove such that the first resilient seal is disposed between the panel and the first wall, and inner surfaces of the first and second walls are spaced apart a distance sufficient to cause the panel to be wedged into the groove without peeling the first resilient seal off the first surface when the panel is inserted into the groove, further wherein a second resilient seal is disposed on a second surface of the panel between the second wall and the second surface, and further wherein the first and second resilient seals substantially covers all of the first and second surfaces of the panel, respectively.

3. The closure of claim 1, wherein the panel transmits ambient light and is one of the group consisting of glass and plastic.

4. The closure of claim 1, wherein the structural frame is one of the group consisting of a door frame and a window.

5. The closure of claim 4, wherein the included angle is between four and ten degrees.

6. The closure of claim 5, wherein the frame is comprised of wood.

7. The closure of claim 1, wherein the first resilient seal has a cured hardness of between 10 and 60 durometer.

8. A gas and liquid resistant closure for a building, comprising:

a structural frame;

a panel having an outer edge mounted within the structural frame;

a first resilient seal which is cured by heat on a first surface of the panel; and a groove located on the frame, the groove having a first and second wall that flare outward at an included angle of less than twenty degrees, wherein the groove is designed to receive the panel and a portion of the first resilient seal such that the first resilient seal is disposed between the panel and the first wall, and inner surfaces of the first and second walls are spaced apart a distance sufficient to cause the panel to be wedged into the groove when the panel is inserted into the groove without peeling the first resilient seal off the first surface.

9. A gas and liquid resistant closure for a building, comprising:

a structural frame;

a panel having an outer edge mounted within the structural frame;

a first resilient seal which is cured by heat on a first surface of the panel; and the frame defining a groove, the groove having a first wall and a second wall that flare outward at an included angle of less than twenty degrees, wherein the panel and a portion of the first resilient seal are positioned in the groove such that the first resilient seal is disposed between the panel and the first wall, and inner surfaces of the first and second walls are spaced apart a distance sufficient to cause the panel to be wedged into the groove without peeling the first resilient seal off the first surface when the panel is inserted into the groove, and further wherein the first resilient seal substantially covers all of the first surface of the panel.

10. The closure of claim 9, wherein a second resilient seal is disposed on a second surface of the panel between the second wall and the second surface.

11. A gas and liquid resistant closure for a building, comprising:

a structural frame;

a panel having an outer edge mounted within the structural frame;

a first resilient seal which is cured by heat on a first surface of the panel;

the frame defining a groove, the groove having a first wall and a second wall that flare outward at an included angle of less than twenty degrees wherein the panel and a portion of the first resilient seal are positioned in the groove such that the first resilient seal is disposed between the panel and the first wall, and inner surfaces of the first and second walls are spaced apart a distance sufficient to cause the panel to be wedged into the groove without peeling the first resilient seal off the first surface when the panel is inserted into the groove, further wherein a second resilient seal is disposed on a second surface of the panel between the second wall and the second surface, and further wherein the first and second resilient seals substantially cover all of the first and second surfaces of the panel, respectively.

12. The closure of claim 9, wherein the first resilient seal has a cured hardness of between 10 and 60 durometer.

13. The closure of claim 9, wherein the frame is constructed of wood.

14. The closure of claim 9, wherein the panel transmits ambient light and is one of the group consisting of glass and plastic.

15. The closure of claim 14, wherein the included angle is between four and ten degrees.

16. The closure of claim 14, wherein the structural frame is one of the group consisting of a door frame and a window frame.

* * * * *

UNITED STATES PATENT AND TRADEMARK OFFICE

CERTIFICATE OF CORRECTION

PATENT NO. : 6,209,272 B1
DATED : April 3, 2001
INVENTOR(S) : Holzaepfel

It is certified that error appears in the above-identified patent and that said Letters Patent is hereby corrected as shown below:

Claim 1, column 7,
Line 22, "cover" should be -- covers --.

Claim 2, column 7,
Line 43, "covers" should be -- cover --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*